US009953610B2

(12) United States Patent
Ding et al.

(10) Patent No.: US 9,953,610 B2
(45) Date of Patent: Apr. 24, 2018

(54) METHOD FOR REGULATING COMMON VOLTAGE, REGULATING DEVICE AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Jinbo Ding, Beijing (CN); Jing Wang, Beijing (CN); Xin Li, Beijing (CN); Ying Zhang, Beijing (CN); Hong Zhu, Beijing (CN); Hongjun Yu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 57 days.

(21) Appl. No.: 15/085,015

(22) Filed: Mar. 30, 2016

(65) Prior Publication Data

US 2016/0300544 A1 Oct. 13, 2016

(30) Foreign Application Priority Data

Apr. 8, 2015 (CN) ..... 2015 1 0164105

(51) Int. Cl.

| | |
|---|---|
| ***G09G 3/36*** | (2006.01) |
| ***G09G 3/00*** | (2006.01) |
| ***G09G 3/20*** | (2006.01) |

(52) U.S. Cl.

CPC ..... *G09G 3/3696* (2013.01); *G09G 3/006* (2013.01); *G09G 3/20* (2013.01); *G09G 3/3648* (2013.01);

(Continued)

(58) Field of Classification Search

None

See application file for complete search history.

(56) References Cited

U.S. PATENT DOCUMENTS

2007/0236484 A1* 10/2007 Oh ..... G09G 3/3614 345/204
2008/0297538 A1 12/2008 Cho et al.
2016/0267855 A1* 9/2016 He ..... G09G 3/36

FOREIGN PATENT DOCUMENTS

CN 202502718 U 10/2012
CN 103616775 A 3/2014

(Continued)

OTHER PUBLICATIONS

Chinese Office Aciton dated Aug. 22, 2016.

*Primary Examiner* — Joseph Haley
(74) *Attorney, Agent, or Firm* — Dilworth & Barrese, LLP; Michael J. Musella, Esq.

(57) ABSTRACT

A method for regulating a common voltage, a regulating device and a display device. It relates to the display field, which ensures the flicker in the center region of the display panel being relative small meanwhile improving the flicker situation of the edge region of the display panel, thereby improve the flicker uniformity of the display panel. The present disclosure provides a method for regulating a common voltage including: arranging sampling points which at least include: sampling points arranged in the center region of the display panel and sampling points arranged in the edge region of the display panel; optimizing the common voltage value written into the driving chip, such that the flicker values of the sampling points located in the display panel are less than or equal to a first threshold when the common voltage value is applied to the display panel for display.

20 Claims, 5 Drawing Sheets

(52) U.S. Cl.
CPC ..... *G09G 2320/0247* (2013.01); *G09G 2320/045* (2013.01)

(56) References Cited

FOREIGN PATENT DOCUMENTS

| | | | |
|---|---|---|---|
| CN | 104217687 | A | 12/2014 |
| KR | 1020060079981 | A | 7/2006 |

* cited by examiner

METHOD FOR REGULATING COMMON VOLTAGE, REGULATING DEVICE AND DISPLAY DEVICE

TECHNICAL FIELD

The present disclosure relates to the display field, and in particular to a method for regulating a common voltage, a regulating device and a display device.

BACKGROUND

A liquid crystal cell of a liquid crystal display is formed by laminating two glass substrates, each of which is provided with an alignment film for guiding the alignment of the liquid crystal. Due to the DC blocking effect of the alignment film and the DC residual voltage caused by the movable ions in the liquid crystal cell, a defective display such as residual image occurs during the display of the liquid crystal display. To solve the defective display caused by the above reasons, the liquid crystal display generally adopts a driving mode of polarity inversion.

When the liquid crystal display adopts a driving mode of polarity inversion for display, a thin film transistor for controlling the loading of a pixel display signal presents a parasitic capacitance effect during charging and discharging, the parasitic capacitance effect will redistribute the charges and a voltage drop effect will occur, that is, to generate a so-called kick back voltage, so that the positive and negative polarity voltage of a source electrode voltage is asymmetry, which causes flicker.

Currently, the problem of flicker caused by the kick back voltage is solved by optimizing a common voltage value written into the LCD driving chip (a common voltage generation circuit provides a common voltage to the display based on the written value), the method is as follows:

S11, illuminating a panel after the attachment of a driving chip and a flexible circuit board, and testing a flicker value of the display panel under flicker pattern;

S12, minimizing the flicker value by regulating the value of the common voltage;

S13, writing into the driving chip the value of the common voltage applied when the flicker value is minimized.

However, the present inventor finds that the common voltage value obtained by the above method has the following problems during the final display: the flicker in the center region of the display panel is relatively small, while the flicker in the edge region is relatively severe; leading the flicker uniformity is poor and influencing the display effect.

SUMMARY

The present disclosure provides a method for regulating a common voltage, a regulating device and a display device, which can ensure the flicker in the center region of the display panel to be relatively small meanwhile improving the flicker condition in the edge region of the display panel, and thus improving the flicker uniformity of the display panel.

To achieve the above purpose, the present disclosure adopts the following technical solutions:

In one aspect, the present disclosure provides a method for regulating a common voltage, comprising: arranging sampling points which at least comprise: sampling points arranged in the center region of the display panel and sampling points arranged in the edge region of the display panel; optimizing the common voltage value written into the driving chip, such that the flicker values of the sampling points located in the display panel are less than or equal to a first threshold when the common voltage value is applied to the display panel for display.

For example, optimizing the common voltage value written into the driving chip, such that the flicker values of the sampling points arranged in the center region of the display panel are minimized in addition that the flicker value of all of the sampling points are less than or equal to the first threshold, when the common voltage value is applied to the display panel for display.

Alternatively, optimizing the common voltage value written into the driving chip further comprises:

setting sequentially the common voltage to a plurality of attempt values, and measuring the flicker value of the sampling point each time an attempt value is set;

for each of the sampling points, fitting a function relational expression of a flicker value of the sampling point with respect to the common voltage according to the tested data of the sampling point;

determining the value range of the common voltage which meets a first condition by using said function relational expression, said first condition is that the flicker values of all of the sampling points are less than or equal to the first threshold;

selecting within said value range of the common voltage, a common voltage value allowing the flicker values of the sampling points arranged in the center region of the display panel being minimized, as the common voltage value written into said driving chip.

Alternatively, said determining the value range of the common voltage that meets a first condition by using said function relational expression further comprises:

S101, figuring out a solution which allows the value of the function relational expression corresponding to each of the sampling points being less than or equal to the first value, said first value is greater than 0 and less than or equal to the first threshold;

S102, if the solution of step S101 exists, terminating the process and taking the solution as a value range of the common voltage which meets the first condition, if the solution of S101 does not exist, circulating step S103 through step S105, until the value range of said common voltage is determined or the value of said flicker value is greater than said first threshold;

S103, providing a value of the flicker value necessary for the present solution, said value of the flicker value is a sum of a value of the flicker value for a previous solution and a preset step, said preset step is 1/K of said first threshold, $K \geq 30$;

S104, determining whether the value of the flicker value necessary for the present solution is less than or equal to said first threshold, if the result of determination is positive, then proceeding with step S105, else, terminating the circulation process;

S105, figuring out a solution which allows the function relational expression corresponding to each of the sampling points being less than or equal to the value of said flicker value, if there is solution, terminating the circulation process and taking the solution as a value range of the common voltage meeting the first condition, else, proceeding with step S103.

Alternatively, said determining the value range of the common voltage which meets a first condition by using said function relational expression further comprises:

S201, presetting n values for the flicker value: P1<P2<P3< . . . <Pn, wherein, n is natural number other than 0, and Pn is less than the first threshold;

S202, operating for each of the values of said flicker value according to ascending order as follows: figuring out a solution which allows the value of the function relational expression corresponding to each of the sampling points being less than or equal to the value of said flicker value, if there is solution, terminating the operation process and taking the solution as a value range of the common voltage meeting the first condition, else, repeating step S202, until the value ranges of said common voltage is determined or the n values for the flicker values all complete the above operation;

S203, figuring out a solution which allows the value of the function relational expression corresponding to each of the sampling points being less than or equal to the value of said first threshold, if there is solution, terminating the process and taking the solution as a value range of the common voltage meeting the first condition, else, terminating the process and taking the display panel as unqualified product.

For example, said n values for flicker values are more than or equal to one third of said first threshold, and less than or equal to two thirds of said first threshold.

Preferably For example, n=3.

For example, said function relational expression is piecewise linearity function expression or quadratic function expression.

For example, said sampling point arranged in the center region of said display panel is one, said sampling points arranged in the edge region of said display panel are four, and are located at four corner regions of said display panel, respectively.

In another aspect, the embodiment of the present disclosure further provides a common voltage regulating device configured for optimizing the common voltage value written into the driving chip, such that the flicker values of the sampling points in the display panel are less than or equal to a first threshold when the common voltage value is applied to the display panel for display, said sampling points at least comprise: sampling points arranged in the center region of said display panel and sampling points arranged in the edge region of said display panel.

Alternatively, said common voltage regulating device comprises:

a screen illuminating unit configured to illuminate the display panel and allow the display panel to operate under flicker pattern;

a common voltage regulating unit configured to set sequentially the common voltage of said display panel into a plurality of attempt values;

a measuring unit configured to measure the flicker values of the sampling points each time said common voltage is set as an attempt value; said sampling points comprise at least: sampling points arranged in the center region of said display panel and sampling points arranged in the edge region of said display panel;

a calculating and processing unit configured to receive a measured data of said measuring unit and optimizing the common voltage value written into the driving chip according to said measured data, such that the flicker values of the sampling points arranged in the center region of the display panel are minimized in condition that the flicker values of all of the sampling points are less than or equal to the first threshold, when the common voltage value is applied to the display panel for display.

Alternatively, the calculating and processing unit comprises:

fitting module configured to fit for each of the sampling points a function relational expression for a flicker value of said sampling point with respect to the common voltage according to the tested data of the sampling point;

a range determining module configured to determine a value range of the common voltage which meets a first condition by using said function relational expression, said first condition is that the flicker values of all of the sampling points are less than or equal to the first threshold;

a preferential selecting module configured to select within said value range of the common voltage, a common voltage value that allows the flicker values of the sampling points arranged in the center region of the display panel being minimized, as the common voltage value written into said driving chip.

Alternatively, said common voltage regulating device further comprises: a writing unit in connected with said calculating and processing unit configured to write said common voltage value determined after optimization into the driving chip.

For example, said sampling point arranged in the center region of said display panel is one, said sampling points arranged in the edge region of said display panel are four, and are located at four corner regions of said display panel, respectively.

The present embodiment further provides a display device comprising a driving chip, the common voltage value written into said driving chip is obtained by the above method for regulating a common voltage.

The present embodiment further provides a method for regulating a common voltage, a regulating device and a display device, the sampling points are arranged in the edge region of the display panel in addition to being arranged in the center region of the display panel, and the common voltage value of the written driving chip is optimized based on the above sampling points, such that the flicker values of the sampling points located in the display panel are all less than or equal to the first threshold when the display panel is displaying. It can be seen that the present disclosure considers not only the flicker situation in the center region but also that in the edge region during the optimization of the common voltage written value, and targets to allow the flicker values in the center region and in the edge region less than or equal to the first threshold, so that the optimized common voltage written value can ensure the flicker in the center region of the display panel being relative small meanwhile improving the flicker situation of the edge region of the display panel, thereby improve the flicker uniformity of the display panel.

BRIEF DESCRIPTION OF THE DRAWINGS

Hereinafter, a brief introduction is made to the drawings necessary for use in the examples to clearly describe the technical solution in the present examples. It is obvious that the drawings described below are merely part of the examples of the present disclosure. Those skilled in the art are able to obtain other drawings on this basis without creative work.

LEGEND

Figure 1:
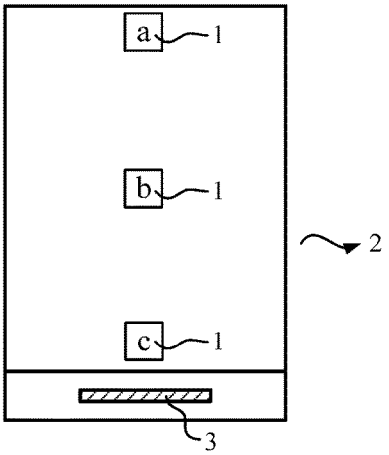
FIG. 1 is a schematic view of the distribution of the sampling points in the display panel in the method for regulating a common voltage provided by the first embodiment of the present invention.

1: sampling points, 2: display panel, 3: driving chip, 81: screen illuminating unit, 82: measuring unit, 83, common voltage regulating unit, 84, calculating and processing unit, 841: fitting module, 842: range determining module, 843: preferential selecting module, 844: controlling module, 85: writing unit.

DETAILED DESCRIPTION OF THE EMBODIMENTS

To solve the problem of flicker uniformity of the display panel, the present inventor conducted detailed analysis to the problem that the flicker in the center region and in the edge region of the display panel when display has relatively great difference, as a result it is found:

On the one hand, since the process during the display panel production process cannot achieve the ideal standard, resulting in thin film transistors (for controlling the display signal loading, hereinafter referred to as TFT) located in different regions of the display panel have different source-drain parasitic capacitance, the kick back voltage generated when TFT charging and discharging is related to the source-drain parasitic capacitance, leading to different kick back voltages in different regions, such that flicker caused by the kick back voltage in different regions is inconsistent.

On the other hand, since the gate lines, data lines on the display panel have an impedance, the signal has delayed when transmitted thereon, leading to a difference in the TFT gate voltage, the TFT source voltage at different regions, further since the kick back voltage generated when TFT charging and discharging is related to the current TFT gate voltage and TFT source voltage, in this respect, it will result in a different kick back voltage generated when TFT charging and discharging at different regions, thus causing the flicker in different regions inconsistent.

Taking into account the central region and the edge regions of the display panel are far away, the flicker inconsistencies problem causes by the above two reasons is particularly evident when comparing the center region with the edge region. In order to improve the flicker inconsistencies problem at the center region and the edge region, and to improve the flicker uniformity of the display panel, the present disclosure provides an improved technical solution, the value written to the display panel common voltage optimization settings, consider reducing not only the kick back voltage in the central region, but also the influence of reducing the kick back voltage in the edge region is considered, such that when the display panel displays, not only the flicker in the center region of the display panel is relatively small, but also the degree of flicker in the edge regions of the display panel is improved, thereby improve the flicker uniformity.

For ease of understanding, the present technical solution will be clearly and completely described hereinafter in conjunction with the accompanying drawings, it is obvious that the described embodiments are merely part of the embodiments of the present invention, but not all embodiments.

Embodiment 1

The present application provides a method for regulating a common voltage, comprising:

Step 1, arranging sampling points which at least comprises: sampling points arranged in the center region of the display panel and sampling points arranged in the edge region of the display panel.

In the method for regulating a common voltage provided by the present embodiment, a flicker level in a region where the sampling points are located is obtained by measuring the flicker values of the sampling points, considering that the degree of flicker differs greatly in the center region and the edge region of the display panel, the present embodiment has at least one sampling point arranged at the center region and the edge region, respectively. The more sampling points and the more uniform for the distribution in the display panel, the more consistent for the flicker after the optimization setting of the common voltage in step 2, nevertheless, it also means the more difficult for the optimization setting of the common voltage in step 2, and more computational complexity. Accordingly, generally it is enough to arrange the sampling points in a representative region under flicker situation, a person skilled in the art can make arrangement with reference to the practical situation or experience when implementation. As shown in FIG. 1, which is a schematic view for an exemplary distribution of the sampling points 1, a sampling point b is arranged in the center region of a display panel 2, a sampling point c is arranged in the edge region close to a driving chip 3 in the display panel 2, and a sampling point a is arranged in the edge region away from the driving chip 3. It can be seen from the previous cause for the flicker uniformity, the flicker situation of a certain region in the display panel is related to a distance from the region to the driving chip, namely the degree of flicker differs in accordance to the distance from the driving chip, thus the distribution of the sampling points should consider the location of the driving chip, for example, one sampling point is arranged in the center region of the display panel and four sampling points are arranged in the edge of the display panel and located in four corner regions of the display panel, respectively. It is obvious that the sampling points can be arranged into other distributions by the designer, such as one sampling point is added between every two adjacent edge sampling points in addition to the above five sampling points.

Step 2. optimizing the common voltage value written into the driving chip, such that the flicker values of the sampling points located in the display panel are less than or equal to a first threshold when the optimized common voltage value is applied to the display panel for display.

The first threshold in step 2 is relevant to the design requirement of the flicker value of the display panel, in particular, the first threshold is generally an upper limit value of the flicker value prescribed in the design requirement of the display panel. If there is no common voltage value that make the flicker values of all the sampling points in the display panel less than or equal to the first threshold, it can be determined that the display panel is not qualified and should be downgraded or subject to rework process. In the present step, the common voltage value written into the driving chip is optimized, there are many ways to implement the same, and will not be described in details herein, only several are exemplified in details hereinafter for comprehension.

In addition, in the method for regulating a common voltage provided by the above embodiment, the optimization standard for the common voltage written value is to have the flicker values of all of the sampling points in the display panel less than or equal to the first threshold, it is noticed that said all of the sampling points comprises at least sampling points arranged in the center region of the display panel (hereafter referred to as a first sampling point) and sampling points arranged in the edge region of the display panel (hereafter referred to as a second sampling point). The common voltage written value is optimized based on the two types of sampling points, so that not only the flicker in the center region where the first sampling point is located is relatively small, but also the flicker in the edge region where the second sampling point is located is relatively small, thereby the difference of the degree of flicker between the center region and the edge region is improved, and the flicker uniformity is improved. The flicker value herein is used to describe the degree of flicker of a certain point in the display panel.

In addition, to optimize the common voltage written value and then write the optimized common voltage written value not only can reduce the flicker of the regions where the sampling points are located, but also improve the residual image of the regions where the sampling points are located, the reasons are as follows: the kick back voltage generated during TFT charging and discharging causes not only the flicker problem but also residual image problem, while the optimized common voltage value can reduce the influence of the kick back voltage, thus improve the residual image to certain degree while improving the flicker problem.

By taking "allowing the flicker value of all of the sampling points in the display panel less than or equal to the first threshold" as the optimization standard, generally one or more continuous value ranges of the common voltage is obtained, to make the display to achieve better display effect, actually the common voltage value written in the driving chip can further be optimized, the standard for the further optimization is: to minimize the flicker value of the sampling point arranged in the center region of the display panel meanwhile allowing the flicker values of all of the sampling points less than or equal to the first threshold, when the optimized common voltage value is applied to the display panel for display. Since the center region of the display panel is a main focus region of the viewer, to reduce the flicker in the center region may further improve the visual enjoyment of the viewer. It is obvious that the standard for the further optimization of the common voltage written value can also be to minimize the flicker difference of the flicker values of all of the sampling points in the display panel so that the written value thus obtained by optimization can improve the flicker uniformity to the greatest extent and reduce the flicker. It is noticed that the standard for the further optimization is not limited thereto and a person skilled in the art is able to make her own design according to the route for obtaining the best display effect.

As an example, introduction will be made hereinafter for how to optimize the common voltage value written into the driving chip, to facilitate the comprehension, description is made now to the design route for optimization process. To obtain a common voltage value which allows the flicker values of all of the sampling points less than or equal to the first threshold, the present inventor intensively studied the relation between the flicker value of an individual sampling point and the common voltage applied to the display panel, and discovered: when the common voltage applied to the display panel is within a certain range, the flicker value of the sampling point generally exhibits variation of decreasing firstly and increasing secondly as the common voltage increases. Based on the above discovery, the present inventor conceived that a function can be fitted by testing the data of a plurality of groups of the flicker values of a certain sampling point varied with the common voltage, and conducting function fitting according to the tested data, the function relational expression obtained by fitting can reflect precisely and completely the relation of the flicker value of the sampling point varied with the common voltage. On the basis of the function relational expression corresponding to each of the sampling points, the common voltage can be optimized by the use of the function relational expression (namely to figure out the solution rendering the function value of the function relational expression less than or equal to the first threshold), so as to obtain precisely the common voltage value that meets the design requirement and write the obtained common voltage value into the driving chip.

Figure 2:
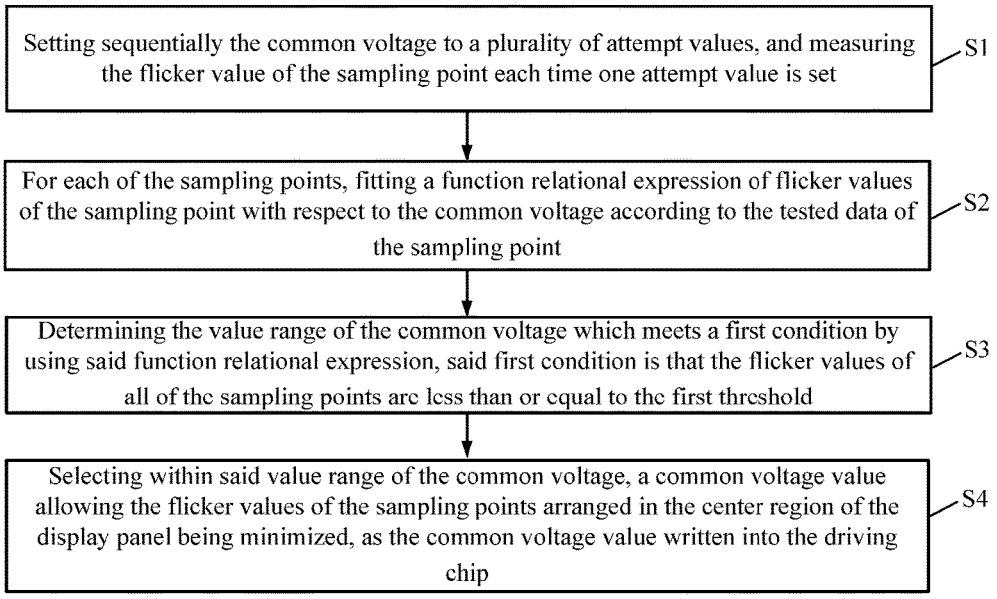
FIG. 2 is a flowchart of a method for regulating a common voltage provided by the first embodiment of the present invention.

Based on the above design route, the optimizing method provided by the present embodiment is shown in FIG. 2, and comprises:

S1. Setting sequentially the common voltage to a plurality of attempt values, and measuring the flicker value of the sampling point each time one attempt value is set.

This step is a test process, and the direct purpose of the tested data is to conduct function simulation, to obtain a function that can relatively precisely reflect the variation of the flicker value of the sampling point with the common voltage. The particular test process can varies, such as each of the sampling points may be tested sequentially, in particular, that is when a certain sampling point is tested, the common voltage is set sequentially to a plurality of attempt values, and the flicker value of the sampling point is measured each time an attempt value is set (one measurement comprises a situation where a mean value is taken for a plurality of measurement under the same attempt value), thereby flicker values of the sampling point under a plurality of attempt values are obtained and another measurement is carried out to another sampling point, finally the tested data for all of the sampling points are obtained; it is also possible that all of the sampling points are tested at the same time when an attempt value is set.

Based on the above design route, the tested data obtained in the present step is to prepare for the fitting of the function relational expression of each of the sampling points in the subsequent steps. As far as a sampling point is concerned, to obtain a function relational expression that can precisely reflect the variation of the flicker values of the sampling point with the common voltage, the tested data for the sampling point are required as follows: (1) to have the function relational expression obtained by fitting reflect the variation of the flicker values of the sampling point, the range of the tested data is required to be widely enough as to reflect the flicker values of the sampling point exhibits variation of decreasing firstly and increasing secondly with the common voltage. (2) To have the function relational expression obtained by fitting precisely reflect the relation between the flicker values of the sampling point and the common voltage, the tested data is required to be enough. In short, it is better for the test process to fit a function relational expression that reflects the variation of the flicker values of the sampling point with common voltage. A person skilled in the art is able to set the attempt values of the common voltage autonomously for this purpose.

S2. For each of the sampling points, fitting a function relational expression of flicker values of the sampling point with respect to the common voltage according to the tested data of the sampling point.

This step is a function fitting process, to obtain a function relational expression that reflects the variation of the flicker values of the sampling point with the common voltage. For particular implement, the step applies a method for function fitting, that is to conduct fitting according to the tested data obtained in the previous step to obtain a definite function relational expression (this step is common knowledge in mathematics field, and the particular method can refer to relevant information and will not repeat herein).

Figure 3:
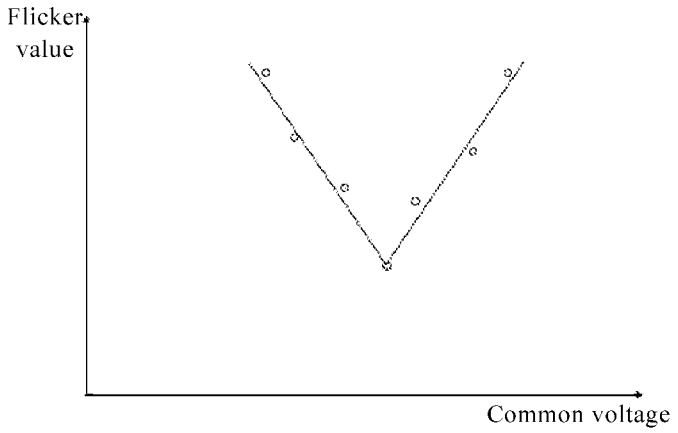
FIG. 3 is a schematic view showing the result of fitting by piecewise linearity function provided by the first embodiment of the present invention.

If the tested data is as shown in FIG. 3, fitting may be conducted by piecewise linearity function, the particular expression is $x>m$, $y=a_1x+k_1$; $x\leq m$, $y=a_2x+k_2$, wherein y is a dependent variable and x is an independent variable, m, $a_1$, $a_2$, $k_1$, $k_2$ are undetermined coefficients, and can be determined based on the tested data when they are implemented particularly. The circle in FIG. 3 indicates a tested data for a certain sampling point, and the broken line therein indicates a piecewise linearity function expression obtained by fitting, it can be seen that they are highly fitted. It is obvious that the fitting function can also be other forms of function, such as a quadratic function, etc., and the particular form can be selected based on the fit, the higher the fit, the more compliance to the requirement for the result after optimization. When the present step is completed, a function relational expression is obtained corresponding to each of the sampling points, which can precisely reflect the variation of the flicker values of the sampling point with the common voltage.

S3, Determining the value range of the common voltage which meets a first condition by using said function relational expression, said first condition is that the flicker values of all of the sampling points are less than or equal to the first threshold.

The present step is a primary optimization process for the common voltage which generally obtains a value range of the common voltage, that is a value range of the common voltage that meets the first condition. Generally, the value range of the common voltage that meets the first condition is one or more continuous value ranges, however other situation is not exclusive, such as one ore more discrete values.

In the present step, if there is a solution, then proceed with a next step; if there is no solution, the display panel is not qualified and should be subject to downgraded or rework process. If the majority of the products in a certain batch have no solution, the design or producing process for the product is need to be improved.

S4, Selecting within said value range of the common voltage, a common voltage value allowing the flicker values of the sampling points arranged in the center region of the display panel being minimized, as the common voltage value written into the driving chip.

The present step is a process for further optimization of the common voltage based on step 3, the purpose for the further optimization is to have the flicker values of the sampling points in the center region of the display panel being minimized, and to finally determine the common value being written into the driving chip.

Figure 7:
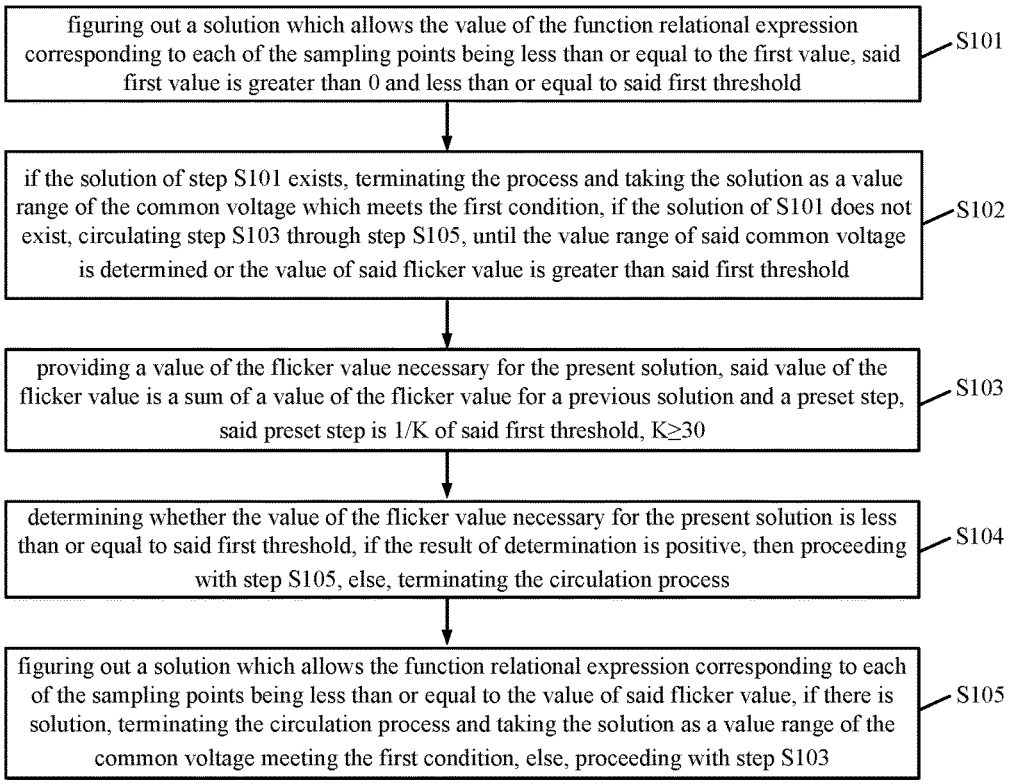
FIG. 7 is a flowchart of a method for determining the value range of the common voltage which meets the first condition provided by the first embodiment of the present invention.

The common voltage written value obtained based on the above steps S1-S4 can improve the flicker uniformity and meanwhile reducing the flicker in the center region of the display panel, thereby further improve the display quality. Wherein step S3 has various embodiments, alternatively, the value range of the common voltage that meets the first condition is determined by function relational expression in step 3, one particular implement is shown in FIG. 7, which comprising:

S101, figuring out a solution which allows the value of the function relational expression corresponding to each of the sampling points being less than or equal to the first value, said first value is greater than 0 and less than or equal to said first threshold.

In the present step, an inequality is formed corresponding to each of the sampling points: $y(x)\leq P$, wherein y(x) is a function relational expression of the flicker values of the sampling points with common voltage, x is a common voltage, P is a first value. Then a set of inequalities is formed by the inequalities corresponding to all of the sampling points and solved, the solving process is completed by a programmable chip automatically, it is obvious that the set of inequalities may also be solved manually.

Figure 4:
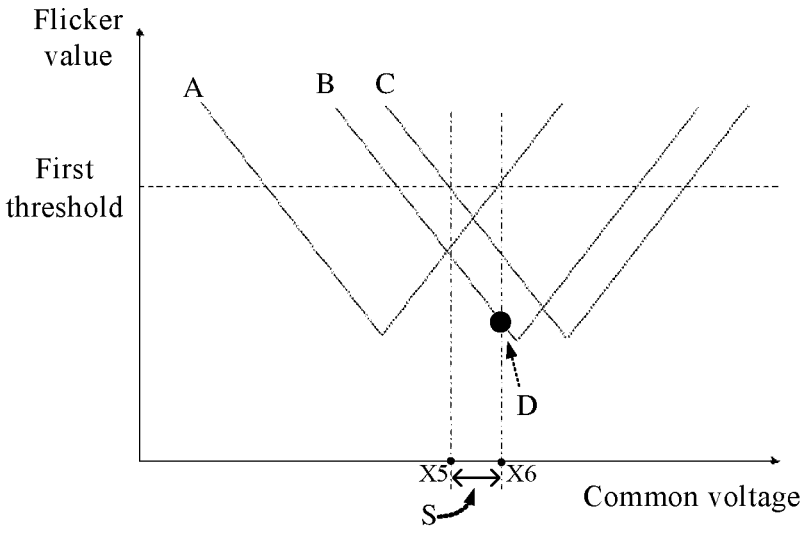
FIG. 4 is a schematic view of a process for determining the common voltage written value being written into the driving chip provided by the first embodiment of the present invention.

Referring to FIG. 4, the first value should be small enough to avoid missing situation when steps 101-105 of the whole method are implemented, meanwhile no necessary computational complexity increases due to the first value being too small. Generally, the first value is determined with reference to the value range of the common voltage that meets the first condition. For example, the first value can be determined according to the following method, calculating the minimum value of the function relational expression corresponding to each of the sampling point, the first value being equal to or slightly less than the smallest value among them.

S102, if the solution of step S101 exists, terminating the process and taking the solution as a value range of the common voltage which meets the first condition, if the solution of S101 does not exist, circulating step S103 through step S105, until the value range of said common voltage is determined or the value of said flicker value is greater than the first threshold.

The present step is a determination step, there are two selections according to the result for solving of step S101: if there is a solution, the solution is determined as a first value range in step S3, and the process for determining the first value range is terminated, that is step S3 is terminated; if there is no solution, then proceed with the subsequent circulation process. It is worthy of mentioning that if there is solution in step S101, a first value range is obtained which allows the flicker values of all of the sampling points less than or equal to the first value, wherein the first value is less than the first threshold, which means the first value range not only enable the flicker value of all of the sampling points to meet the design requirement, but also have the flicker of all of the sampling points being more uniform.

S103, providing a value of the flicker value necessary for the present solution, said value of the flicker value is a sum of a value of the flicker value for a previous solution and a preset step, said preset step is 1/K of said first threshold, K≥30.

The present step is a starting step of each of the circulation in the circulation process, for generating a value for the flicker value, said "solving" means to figure out the solution of the following set of inequalities which includes inequalities corresponding to each of the sampling points: y(x)≤P, wherein y(x) is a function relational expression of the flicker values of the sampling points with common voltage, x is a common voltage, P is a value of the flicker value necessary for the present solution.

The value of the flicker value in the first circulation is a sum of a first value and a preset step, and the value of the flicker value in the following each circulation is a sum of a value of the flicker value in the previous circulation and a preset step, such that the value of the flicker value generated in the circulation process increases gradually as the circulation increases. For example, the value P1 of the flicker value in the first circulation is (1+1/K) time to that of the first value, and the value P2 of the flicker value in the second circulation is (1+1/K+1/K) time to that of the first value, and so forth, the value Pn of the flicker value in the nth circulation is (1+n/K) time to that of the first value.

S104, determining whether the value of the flicker value necessary for the present solution is less than or equal to said first threshold, if the result of determination is positive, then proceeding with step S105, else, terminating the circulation process.

The present step provides a termination condition for circulation process, when the value generated for the flicker value is more than the first threshold and there is no solution of the set of inequalities in the previous circulation process, the circulation is terminated and the whole optimization process is terminated, the display panel is determined as not qualified and should be subject to downgraded or rework process. If the majority of the products in a certain batch have no solution, the design or producing process for the product is need to be improved.

S105, figuring out a solution which allows the function relational expression corresponding to each of the sampling points being less than or equal to the value of said flicker value, if there is solution, terminating the circulation process and taking the solution as a value range of the common voltage meeting the first condition, else, proceeding with step S103.

The present step is described taking a certain circulation as an example, firstly, a set of inequalities in the circulation is solved and two selections can be made according to the solution result: if there is a solution, the solution is determined as a first value in step S3, and the circulation process is terminated, so as to terminate step S3; if there is no solution, then proceed with the circulation process, and enter the next calculation till solving the set of inequalities in a certain calculation, or if always no solution while the value of the flicker value generated is more than the first threshold.

It is known from the above that steps S103-S105 are a circulation process, each of which will firstly generate a value of a flicker value, and in the premise that the value of the flicker value is not more than the first threshold, figuring out a solution which allows the function relational expression corresponding to each of the sampling points less than or equal to the value of the flicker value, if there is a solution, the solution is a first value range, if there is no solution, adding a preset step to the value of the flicker value in the next circulation and proceed with calculation. To limit the maximum of the preset step to 1/30 of the first threshold is due to the following consideration: (1) the longer the preset step, the higher risk of misjudgment. Assuming the first threshold is 10, the first value is 1, the inequality y(x)≤P corresponding to the sampling points has solution when P is more than or equal to 9.5, if the preset step is set to be 2, y(x)≤P has no solution, and the value for the next flicker value is 11 which is more than the first threshold, the circulation process will end and misjudge that there is no first value range that allows y(x)≤P, while when the preset step is set to be 1/3, a first value range can be determined, the smaller the preset step, the less risk for "misjudgment" generated by long step. (2) The smaller the preset step, the less risk for misjudgment, while the corresponding computational complexity is larger. In combination of the above two aspects, it is preferable to set the preset step to be less than or equal to 1/30 of the first threshold.

Figure 8:
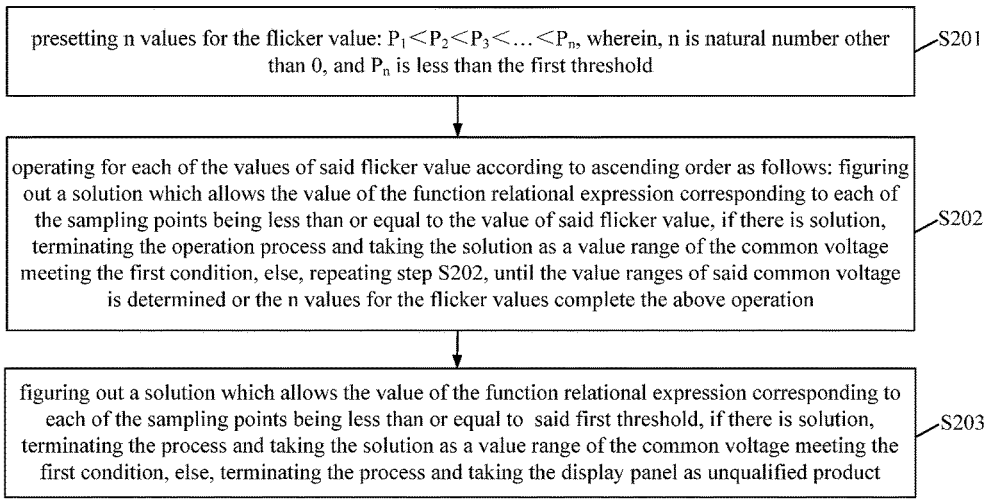
FIG. 8 is another flowchart of a method for determining the value range of the common voltage which meets the first condition provided by the first embodiment of the present invention.

In conclusion, during the optimization process for the first value range in steps S101-S105, we should not only target to meet the first condition but also target to reduce the flicker value of all of the sampling points as much as possible, so as to obtain the first value range meanwhile have the flicker of all of the sampling points more uniform correspondingly. In addition to the method in steps S101-S105, it is also possible to determine the value range of the common voltage which meets the first condition by the function relational expression by using other methods, such as the method as shown in FIG. 8, which comprises:

S201, presetting n values for the flicker value: $P_1<P_2<P_3<\ldots<P_n$, wherein, n is natural number other than 0, and $P_n$ is less than the first threshold.

For example, the n values for the flicker values in the present step are more than or equal to one third of said first threshold, and less than or equal to two thirds of said first threshold.

According to the implementation experience, the minimum value of the function relational expression corresponding to the sampling point is generally 0 to about one third of the first threshold, hence $P_1, P_2, P_3 \ldots P_n$ in the present step are all set to be more than one third of the first threshold, which can reduce the subsequent operation time; while to limit the maximum value among $P_1, P_2, P_3 \ldots P_n$ to two thirds of the first threshold are due to the following two aspects: on the one hand, it is known from implementation experience that the flicker value of each of the sampling points corresponding to the optimized common voltage value written into the driving chip generally is no more than two thirds of the first threshold, thereby the maximum value among $P_1, P_2, P_3 \ldots P_n$ is limited to be two thirds of the first threshold, such that the subsequent operation time can be reduced; on the other hand, as compared to having the flicker value of all of the sampling points equal to the first threshold, the display effect when the flicker value of all of the sampling points are less than or equal to two thirds of the first threshold is much better, it is more desirable for the designers to find a common voltage that can allow the flicker value of all of the sampling points less than the first threshold, thereby the maximum value among $P_1, P_2, P_3 \ldots P_n$ is limited to two thirds of the first threshold. It is clear to a person skilled in the art that the scope of $P_1, P_2, P_3 \ldots P_n$ are not limited to that set in the present step. In short, to preset n values for the flicker value: the value of $P_1$, $P_2$, $P_3$ . . . $P_n$ ensures that there is no missing solution for the inequality, meanwhile the computational complexity during the whole solving process is reduced as much as possible.

For example, n=3. 3 is selected as the number of the values of the flicker values, under the consideration of improving the computing efficiency. It is obvious for the designer to adjust the number of the values of the flicker values by a comprehensive consideration of factors as computing speed of the computing equipment and the like, without affecting the production efficiency.

As an example, P1, P2, and P3 are valued of ⅓, ½, and ⅔ of the first threshold.

S202, operating for each of the values of said flicker values according to ascending order as follows: figuring out a solution which allows the value of the function relational expression corresponding to each of the sampling points being less than or equal to the value of said flicker value, if there is solution, terminating the operation process and taking the solution as a value range of the common voltage meeting the first condition, else, repeating step S202, until the value range of said common voltage is determined or the n values for the flicker values complete the above operation.

The present step per se is a circulation step, one of the flicker values $P_1$, $P_2$, $P_3$ . . . $P_n$ is selected according to ascending order in each circulation, for example, Pm is selected in the mth circulation (m is natural number other than 0). Then the value of the selected flicker value is operated for solution, taking Pm as an example to describe the solving process, namely the following set of inequalities is solved which includes inequalities corresponding to each of the sampling points, each of the sampling points form a corresponding inequality: $y(x) \leq P_m$, wherein y(x) is a function relational expression of the flicker value of the sampling point with the common voltage, x is a common voltage. The condition to terminate the present step is: when a first value range is determined in a certain circulation, the circulation process is terminated and step S3 is terminated; or when $P_1$, $P_2$, $P_3$ . . . $P_n$ are circulated, the circulation process is terminated.

S203, figuring out a solution which allows the value of the function relational expression corresponding to each of the sampling points being less than or equal to the value of said first threshold, if there is solution, terminating the process and taking the solution as a value range of the common voltage meeting the first condition, else, terminating the process and taking the display panel as unqualified product.

This step is the last one in step S1, and is only two results: either there is a solution so that the first value range is determined, or there is no solution such that the display panel is determined unqualified product. It is noticed that if the set of inequalities corresponding to the first threshold does not has solution, it is indicated that there is whatever no common voltage value that meets the first condition, and the production of the display panel may have problem, such that no product that meets the design requirement of the present example can be produced, and the product may be firstly determined as unqualified, and should wait for the subsequent detection and process.

Figure 6:
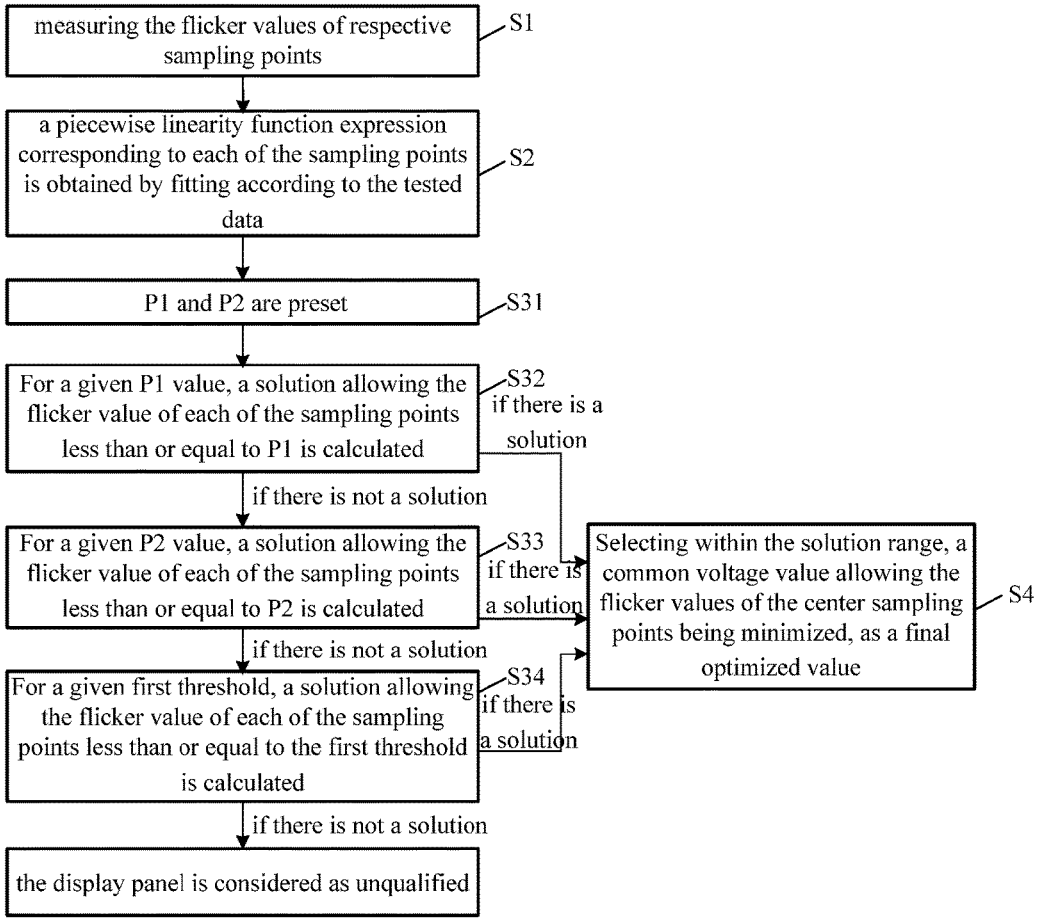
FIG. 6 is a flowchart of a first exemplary provided by the first embodiment of the present invention.

To help understanding the above process, we provide two particular exemplified examples:

Exemplified example 1, the flowchart of this exemplified example is shown in FIG. 6, wherein the arrangement of the sampling points in the display panel is shown as FIG. 1. In step S1, tested data for sampling points a, b and c are obtained. In step S2, a piecewise linearity function expression corresponding to each of the sampling points is obtained by fitting according to the tested data of the sampling points, as shown in FIG. 4, the curves A, B, and C represents the function relational expression y1 (x), y2 (x), and y3 (x) corresponding to the samplings a, b and c in FIG. 1, respectively. Step S3 is detailed as follows:

Firstly, in step S31, 2 values of flicker values are preset as P1 and P2, and P1<P2<the first threshold.

In step S32, a set of inequalities is calculated for a solution, with respect to a given P1 value: $y1(x) \leq P1$, $y2(x) \leq P1$, $y3(x) \leq P1$, if there is a solution, namely, $X1 \leq x \leq X2$, the range will be determined as a first value range. In step S4, a value Xa for x when the y2 (x) is minimized within the first value range is calculated according to the function relational expression y2 (x) of the sampling point b, the Xa thus obtained is the final optimized value.

For a given P1 value, if the set of inequalities: $y1(x) \leq P1$, $y2(x) \leq P1$, $y3(x) \leq P1$ has no solution, the step S33 is carried out, for a given predetermined value P2, a set of inequalities $y1(x) \leq P2$, $y2(x) \leq P2$, $y3(x) \leq P2$ is calculated for a solution, if there is a solution, it means there is a solution allowing the flicker value of each of the sampling points less than or equal to P1, and this range is determined as a first value range. Then in step S4, a value Xb for x when the y2 (x) is minimized within the first value range is calculated according to the function relational expression y2 (x) of the sampling point b, the Xb thus obtained is the final optimized value.

In the above process, in step S33, for a given P2 value, if the set of inequalities: $y1(x) \leq P1$, $y2(x) \leq P1$, $y3(x) \leq P1$ still has no solution, continue to step S34, for a first threshold, a set of inequalities y1 (x)≤the first threshold, y2 (x)≤the first threshold, y3 (x)≤the first threshold is calculated for a solution, if there is a solution, this range is determined as a first value range, and a value Xc for x when the y2(x) is minimized within the first value range is calculated according to the function relational expression y2 (x) of the sampling point b, the Xc thus obtained is the final optimized value, then as shown in FIG. 4, for a given first threshold, the first value range is determined as S (namely, $X5 \leq x \leq X6$), then a common voltage when y2 (x) is minimized is a x-coordinate corresponding to the black dot D (namely the optimized common voltage value finally determined for being written into the driving chip).

In the above process, if for a given first threshold, there is still no solution to the set of inequalities y1 (x)≤the first threshold, y2 (x)≤the first threshold, y3 (x)≤the first threshold, the display panel is considered as unqualified.

Figure 5:
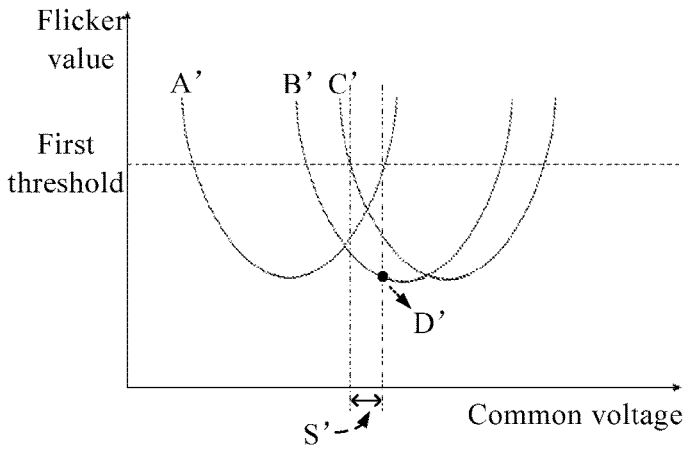
FIG. 5 is a schematic view of a process for determining the common voltage written value being written into the driving chip after fitting by quadratic function provided by the first embodiment of the present invention.

Exemplified example 2, wherein the arrangement of the sampling points in the display panel is shown as FIG. 1. In step S1, tested data for sampling points a, b and c are obtained. In step S2, a quadratic function expression corresponding to each of the sampling points is obtained, and the curves draw according to the function relational expression is shown in FIG. 5, the curves A', B', and C' represents the function relational expression corresponding to the samplings a, b and c in FIG. 1, respectively. In step S3, the first value range is determined as S'. In FIG. 4, a common voltage written value is determined as an x-coordinate corresponding to the black dot D. The particular implement process is generally similar to the exemplified example 1, and will be omitted.

In conclusion, the first value range obtained by step S203 will necessarily meet the first condition, and the first value range obtained by step S201-S202 can allow the flicker values of all of the sampling points less than the first threshold, such that the flicker of all of the flicker points is more uniform as compared to the design requirement.

The above particular exemplified examples are all on the basis that the function relational expression can precisely reflect the variation of the flicker value with the common voltage. For example, a piecewise linearity function expression or a quadratic function expression is used for simulation. On one hand, the flicker value of the sampling point generally exhibits variation of decreasing firstly and increasing secondly as the common voltage increases based on test experience, so it is proper to use the piecewise linearity function expression and the quadratic function expression to describe the variation; on the other hand, since the piecewise linearity function expression and the quadratic function expression are easy and convenient for the operation during the solving process, it is a preferred solution. It is obvious for the designer to fit the tested data of each of the sampling points to other function relational expression as long as the function relational expression and the tested data are relatively highly fitted, the present example will not make limitation.

By the method for regulating the common voltage provided in the present example, an optimized common voltage written value is obtained which can ensure the flicker in the center region is relatively small and the flicker in the edge region is effectively improved when the display panel displays.

Embodiment 2

The present example provides a common voltage regulating device configured for optimizing the common voltage value written into the driving chip, such that the flicker values of the sampling points in the display panel are less than or equal to a first threshold when the common voltage value is applied to the display panel for display, said sampling points at least comprises: sampling points arranged in the center region of said display panel and sampling points arranged in the edge region of said display panel.

The common voltage regulating device of the present embodiment is used for implementing the method for regulating the common voltage of embodiment 1, optimizing the common voltage written value of the driving chip, so that when the common voltage written value obtained after optimizing in the present embodiment is applied to the display panel for display, not only the flicker in the center region is relatively small, but also the flicker in the edge regions are improved and the flicker uniformity is relatively good.

Figure 9:
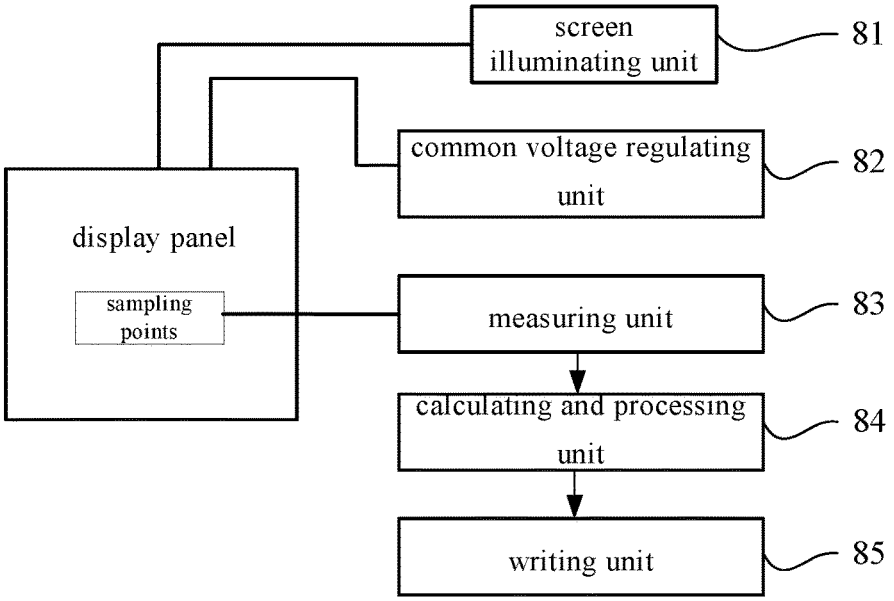
FIG. 9 is a structural block of the common voltage regulating device provided in the second embodiment of the present invention.

Referring to FIG. 9, the common voltage regulating device of the present embodiment comprises a screen illuminating unit 81 configured to illuminate the display panel and allow the display panel to operate under flicker pattern; a common voltage regulating unit 82 configured to set sequentially the common voltage of said display panel into a plurality of attempt values; a measuring unit 83 configured to measure the flicker values of the sampling points each time said common voltage is set as an attempt value; said sampling points comprise at least: sampling points arranged in the center region of said display panel and sampling points arranged in the edge region of said display panel; a calculating and processing unit 84 configured to receive a measured data of said measuring unit and optimizing the common voltage value written into the driving chip according to said measured data, such that the flicker values of the sampling points arranged in the center region of the display panel are minimized in condition that the flicker values of all of the sampling points are less than or equal to the first threshold, when the common voltage value is applied to the display panel for display.

Wherein, the screen illuminating unit 81 is configured to provide backlight necessary for illuminating the display panel and to transmit the driving signal to the display panel to allow the display panel to operate under flicker pattern. The flicker pattern is a display pattern of the display panel, when display under such pattern, all of the pixels having same driving polarity in a same frame are open and set to be gray, while pixels having opposite driving polarity are closed. Since the flicker of adjacent pixels of opposite driving polarity would occur neutralization phenomenon, when the display panel is operated under flicker pattern, the flicker situation may be maximized, which facilitates to precisely determine the flicker situation of the display panel.

The common voltage regulating unit 82 may transmit a necessary common voltage signal to the display panel, and have a function of regulating the voltage value, so as to set the common voltage of the display panel into different common voltage value. The measuring unit 83 is configured to measure the flicker value of each of the sampling points and may be a photoelectric sensor, for implementing, each of the sampling points may be provided with a photoelectric sensor for specifically measuring its flicker value; it is also possible to arrange one photoelectric sensor for the whole display panel, and to obtain the flicker value of the sampling point at corresponding location of the display panel based on the sensing signal at different location of the panel sensor. For practical measurement, the common voltage regulating unit 82 and the measuring unit 83 cooperate with each other to complete the measurement of the flicker value of each of the sampling points in the display panel under different common voltage attempt values.

Figure 10:
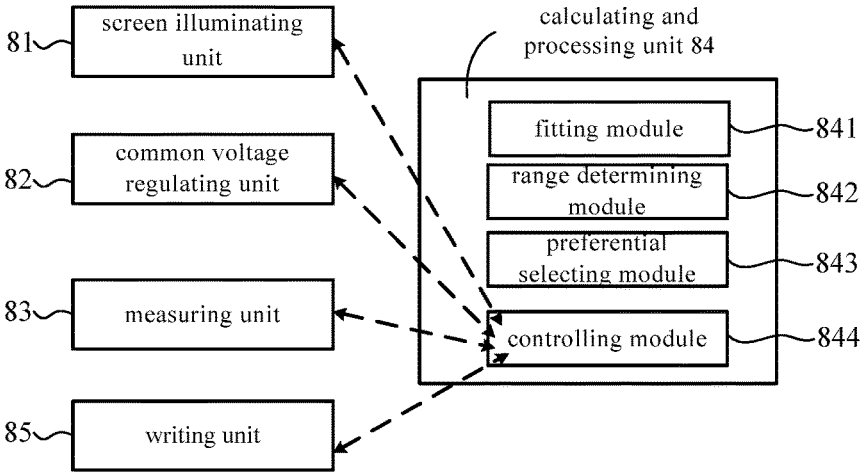
FIG. 10 is a preferable structural schematic view of the common voltage regulating device provided in the second embodiment of the present invention.

The calculating and processing unit 84 has an independent programmable functional chip, and the calculating and processing unit 84 may also be integrated into a component with the common voltage regulating unit 82. Alternatively, as shown in FIG. 10, the calculating and processing unit 84 comprises: a fitting module 841 configured to fit for each of the sampling points a function relational expression for a flicker value of said sampling point according to the tested data of the sampling point; a range determining module 842 configured to determine a value range of the common voltage which meets a first condition by using said function relational expression, said first condition is that the flicker values of all of the sampling points are less than or equal to the first threshold; a preferential selecting module 843 configured to select within said value range of the common voltage, a common voltage value that allows the flicker values of the sampling points arranged in the center region of the display panel being minimized, as the common voltage value written into the driving chip. The particular operation method for each component may refer to the relevant content in embodiment 1. The particular operation process of the calculating and processing unit 84 can refer to the optimization process in embodiment 1.

Alternatively, as shown in FIG. 9, the common voltage adjusting device further comprises a writing unit 85 in connected with said calculating and processing unit 84 configured to write the common voltage value determined after optimization into the driving chip.

The present embodiment provides a common voltage adjusting device, for implementing the method for regulating the common voltage in embodiment 1 so as to obtain an optimized common voltage value, and write the optimized common voltage into the driving chip of the display panel.

When the optimized common voltage value is applied to the display panel for display, the flicker uniformity is relatively good, thus a relatively high display quality may be obtained.

As shown in FIG. 10, which is a preferable solution of the present embodiment, the present embodiment provides a common voltage adjusting device, wherein, the screen illuminating unit 81, the common voltage regulating unit 82, the measuring unit 83, and the writing unit 85 are connected to the controlling module 844 of the calculating and processing unit 84, respectively. Wherein, under the control of the controlling module 844, firstly the screen illuminating unit 81 completes the screen illuminating operation, the common voltage regulating unit 82 regulates and outputs the proper common voltage value, the measuring unit 83 completes the measuring operation for one or more sampling points under one common voltage value; after completing the measurement, the calculating and processing unit 84 completes the optimization process of embodiment 1 automatically and obtain an optimum value of the common voltage written into the driving chip, which is written into the driving chip by the writing unit 85, in short, under the control of the controlling module 844, the common voltage adjusting device complete the process of measuring the data, optimizing and writing in embodiment 1 automatically.

The common voltage regulating device provided in the present embodiment cooperates the method for regulating the common voltage in embodiment 1 and can obtain an optimized common voltage value, which is written into the driving chip of the display panel. When the optimized common voltage value is applied to the display panel for display, the flicker uniformity is relatively good, thus a relatively high display quality may be obtained.

Embodiment 3

The present embodiment provides a display device comprising a driving chip, the common voltage value written into the driving chip is obtained by the above method for regulating a common voltage. Based on the discussion in the previous embodiment, it is known that since the common voltage value written into the driving chip is obtained by the above method for regulating a common voltage, the display device has relatively good flicker uniformity when display and relatively good display effect. The display panel may be any product or component having display function as liquid crystal panel, E-paper, mobile, tablet computer, television, monitor, notebook, digital camera, navigator, and the like.

It is understood to a person skilled in the art that all or part of the processes for achieving the method in the above embodiment may be completed by a relevant hardware instructed by a computer program, all of the programs may be stored in a computer readable storage medium, wherein the computer readable storage medium may be hard disk, disk, Read-Only Memory, or Random Access Memory, etc.

The foregoing is only preferred embodiments of the present invention, it is not intended to limit the present invention, any modifications or substitution easily conceived by a person skilled in the art are within the scope of protection of the present invention based on the disclosure of the present invention. Accordingly, the scope of the invention should be subject to the scope of the claims.

The present application claims priority to Chinese Patent Application No. 201510164105.5 filed on Apr. 8, 2015, the contents of which are hereby incorporated by reference in its entirety as part of the disclosure of the present application.

What is claimed is:

1. A method for regulating a common voltage of a display panel, comprising:

arranging at least one sampling point located in a center region of the display panel and at least one sampling point located in an edge region of the display panel;

optimizing the common voltage value to be written into a driving chip, such that flicker values of all the sampling points located in the display panel are less than or equal to a first threshold when the common voltage value is applied to the display panel for display;

wherein in a case in which the flicker values of all the sampling points located in the display panel are less than or equal to the first threshold, the common voltage value, which allows the flicker value of the at least one sampling point located in the center region of the display panel to be minimized, is selected as the common voltage value to be written into said driving chip.

2. The method according to claim 1, wherein, the common voltage value to be written into the driving chip is optimized, such that the flicker value of the at least one sampling point located in the center region of the display panel is minimized in condition that the flicker values of all of the sampling points are less than or equal to the first threshold, when the common voltage value is applied to the display panel for display.

3. The method according to claim 2, wherein, optimizing the common voltage value to be written into to the driving chip further comprises:

for each of the sample points, setting a plurality of test values for the common voltage sequentially, and measuring the flicker values of each of the sampling points corresponding to the plurality of test values;

for each of the sampling points, fitting a function relational expression of a flicker value of the sampling point with respect to the common voltage according to the measured flicker values of each of the sampling points;

determining a value range of the common voltage which meets a first condition by using said function relational expression, wherein said first condition represents that the flicker values of all of the sampling points are less than or equal to the first threshold;

selecting within said value range of the common voltage, the common voltage value, which allows the flicker value of the at least one sampling point located in the center region of the display panel to be minimized as the common voltage value to be written into said driving chip.

4. The method according to claim 3, wherein, determining the value range of the common voltage which meets the first condition by using said function relational expression further comprises steps:

S101, figuring out a solution which allows a value of the function relational expression corresponding to each of the sampling points being less than or equal to a first value, wherein said first value is greater than 0 and less than or equal to said first threshold;

S102, if the solution of step S101 exists, terminating the process and taking the solution as the value range of the common voltage which meets the first condition, if the solution of S101 does not exist, circulating step S103 through step S105, until the value range of said common voltage is determined or the value of said flicker value is greater than said first threshold;

S103, providing a value of the flicker value for a present solution, wherein said value of the flicker value for the present solution is a sum of a value of the flicker value for a previous solution and a preset step, said preset step being 1/K of said first threshold, K≥30;

S104, determining whether the value of the flicker value for the present solution is less than or equal to said first threshold, if a result of determination is positive, then proceeding with step S105, else, terminating the circulation process;

S105, figuring out a solution which allows the function relational expression corresponding to each of the sampling points being less than or equal to the value of said flicker value, if there is solution, terminating the circulation process and taking the solution as the value range of the common voltage which meets the first condition, else, proceeding with step S103.

5. The method according to claim 3, wherein, determining the value range of the common voltage which meets the first condition by using said function relational expression further comprises:

S201, presetting n values for the flicker value: $P_1<P_2<P_3<\ldots<P_n$, wherein, n is natural number other than 0, and $P_n$ is less than the first threshold;

S202, performing a calculation for each of the values of said flicker value according to ascending order as follows: figuring out a solution which allows the value of the function relational expression corresponding to each of the sampling points being less than or equal to the value of said flicker value, if there is a solution, terminating the calculation and taking the solution as the value range of the common voltage meets the first condition, else, repeating step S202, until the value ranges of said common voltage is determined or the –n values for the flicker complete the above operation;

S203, figuring out a solution which allows the value of the function relational expression corresponding to each of the sampling points being less than or equal to the value of said first threshold, if there is a solution, terminating the process and taking the solution as the value range of the common voltage which meets the first condition, else, terminating the process and taking the display panel as a unqualified product.

6. The method according to claim 5, wherein, said n value for flicker value are more than or equal to one third of said first threshold, and less than or equal to two thirds of said first threshold.

7. The method according to claim 6, wherein, n=3.

8. The method according to claim 3, wherein, said function relational expression is a piecewise linearity function expression or a quadratic function expression.

9. The method according to claim 1, wherein, one sampling point is located in the center region of said display panel, and four sampling points are located in the edge region of said display panel and are located at four corner regions of said display panel, respectively.

10. A common voltage regulating device for a display panel, which configured to optimize a common voltage value to written into a driving chip, such that flicker values of all the sampling points in the display panel are less than or equal to a first threshold when the common voltage value is applied to the display panel for display, wherein said sampling points comprises at least one sampling point located in a center region of said display panel and at least one sampling point located in an edge region of said display panel;

wherein in a case in which the flicker values of all the sampling points located in the display panel are less than or equal to the first threshold, the common voltage value, which allows the flicker value of the at least one sampling point located in the center region of the display panel to be minimized, is selected as the common voltage value to be written into said driving chip.

11. The common voltage regulating device according to claim 10, wherein, said common voltage regulating device comprises comprising:

a screen illuminating unit backlight configured to illuminate the display panel and allow the display panel to operate under a flicker pattern;

a common voltage regulating circuit configured to set a plurality of test values for the common voltage of said display panel sequentially for each of the sampling points;

a photoelectric sensor configured to measure the flicker values of each of the sampling points in the display panel corresponding to the plurality of test values;

a processor configured to receive the measured flicker values of each of the sampling points and optimize the common voltage value to be written into the driving chip according to said measured flicker values, such that the flicker value of the at least sampling point located in the center region of the display panel is minimized in condition that the flicker values of all of the sampling points are less than or equal to the first threshold, when the common voltage value is applied to the display panel for display.

12. The common voltage regulating device according to claim 11, wherein the processor is further configured to:

fit, for each of the sampling points, a function relational expression for a flicker value of said sampling point according to the measured flicker values of each of the sampling points;

determine a value range of the common voltage which meets the first condition by using said function relational expression, wherein said first condition represents that the flicker values of all of the sampling points are less than or equal to the first threshold; and select within said value range of the common voltage, the common voltage value, which allows the flicker value of the at least one sampling point located in the center region of the display panel to be minimized, as the common voltage value to be written into said driving chip.

13. The common voltage regulating device according to claim 12, further comprising:

a writing circuit connected with the processor and configured to write the optimized common voltage value into the driving chip.

14. The common voltage regulating device according to claim 10, wherein, one sampling point is located in the center region of said display panel, and four sampling point are located in the edge region of said display panel, and at four corner regions of said display panel, respectively.

15. A display device, comprising a driving chip, wherein a common voltage value to be written into said driving chip is obtained as follows:

arranging at least one sampling point located in a center region of the display panel and at least one sampling point located in an edge region of the display panel;

optimizing the common voltage value to be written into a driving chip, such that flicker values of all the sampling points located in the display panel are less than or equal to a first threshold when the common voltage value is applied to the display panel for display;

wherein in a case in which the flicker values of all the sampling points located in the display panel are less than or equal to the first threshold, the common voltage value, which allows the flicker value of the at least one sampling point located in the center region of the display panel to be minimized, is selected as the common voltage value to be written into said driving chip.

16. The display device according to claim 15, wherein the common voltage value to be written into the driving chip is optimized, such that the flicker value of the at least one sampling point located in the center region of the display panel is minimized in condition that the flicker values of all of the sampling points are less than or equal to the first threshold, when the common voltage value is applied to the display panel for display.

17. The display device according to claim 16, wherein, optimizing the common voltage value to be written into to the driving chip further comprises:

for each of the sample points, setting a plurality of test values for the common voltage sequentially, and measuring the flicker values of each of the sampling points corresponding to the plurality of test values;

for each of the sampling points, fitting a function relational expression of a flicker value of the sampling point with respect to the common voltage according to the measured flicker values of each of the sampling points;

determining a value range of the common voltage which meets a first condition by using said function relational expression, wherein said first condition represents that the flicker values of all of the sampling points are less than or equal to the first threshold;

selecting within said value range of the common voltage, the common voltage value, which allows the flicker value of the at least one sampling point located in the center region of the display panel to be minimized, as the common voltage value to be written into said driving chip.

18. The display device according to claim 17, wherein, determining the value range of the common voltage which meets the first condition by using said function relational expression further comprises steps:

S101, figuring out a solution which allows a value of the function relational expression corresponding to each of the sampling points being less than or equal to a first value, wherein said first value is greater than 0 and less than or equal to said first threshold;

S102, if the solution of step S101 exists, terminating the process and taking the solution as the value range of the common voltage which meets the first condition, if the solution of S101 does not exist, circulating step S103 through step S105, until the value range of said common voltage is determined or the value of said flicker value is greater than said first threshold;

S103, providing a value of the flicker value for a present solution, wherein said value of the flicker value for the present solution is a sum of a value of the flicker value for a previous solution and a preset step, said preset step being 1/K of said first threshold, K≥30;

S104, determining whether the value of the flicker value for the present solution is less than or equal to said first threshold, if a result of determination is positive, then proceeding with step S105, else, terminating the circulation process;

S105, figuring out a solution which allows the function relational expression corresponding to each of the sampling points being less than or equal to the value of said flicker value, if there is solution, terminating the circulation process and taking the solution as the value range of the common voltage which meets the first condition, else, proceeding with step S103.

19. The display device according to claim 17, wherein, wherein, determining the value range of the common voltage which meets the first condition by using said function relational expression further comprises:

S201, presetting n values for the flicker value: $P_1<P_2<P_3<\ldots<P_n$, wherein, n is natural number other than 0, and $P_n$ is less than the first threshold;

S202, performing a calculation for each of the values of said flicker value according to ascending order as follows: figuring out a solution which allows the value of the function relational expression corresponding to each of the sampling points being less than or equal to the value of said flicker value, if there is solution, terminating the calculation and taking the solution as the value range of the common voltage which meets the first condition, else, repeating step S202, until the value ranges of said common voltage is determined or the calculation is completed for the n values for the flicker value;

S203, figuring out a solution which allows the value of the function relational expression corresponding to each of the sampling points being less than or equal to the value of said first threshold, if there is a solution, terminating the process and taking the solution as the value range of the common voltage which meets the first condition, else, terminating the process and taking the display panel as a unqualified product.

20. The display device according to claim 19, wherein, said n value for flicker value are more than or equal to one third of said first threshold, and less than or equal to two thirds of said first threshold.

* * * * *